United States Patent [19]

Van Breemen

[11] Patent Number: 4,852,744

[45] Date of Patent: Aug. 1, 1989

[54] TARPAULIN CORNER PROTECTOR

[76] Inventor: Charles A. Van Breemen, 825 Evergreen St., Burbank, Calif. 91505

[21] Appl. No.: 233,879

[22] Filed: Aug. 15, 1988

Related U.S. Application Data

[63] Continuation of Ser. No. 90,143, Aug. 27, 1987, abandoned.

[51] Int. Cl.[4] ..... B65D 81/00; B65D 61/00

[52] U.S. Cl. ..... 206/586; 206/453; 217/69; 248/345.1; 229/DIG. 1

[58] Field of Search ..... 206/453, 586; 217/69; 248/345.1; 229/DIG. 1

[56] References Cited

U.S. PATENT DOCUMENTS

| | | | |
|---|---|---|---|
| 1,195,908 | 8/1916 | Cochrane . | |
| 1,320,205 | 10/1919 | Cochrane | 217/69 |
| 3,762,626 | 10/1973 | Dorsey | 206/586 |
| 4,153,230 | 5/1979 | Giacin | 229/DIG. 1 |
| 4,496,054 | 1/1985 | Koltun | 206/586 |

FOREIGN PATENT DOCUMENTS

| | | | |
|---|---|---|---|
| 3149506 | 6/1983 | Fed. Rep. of Germany | 206/586 |
| 1224493 | 3/1971 | United Kingdom | 206/586 |
| 1480742 | 7/1977 | United Kingdom | 206/586 |

*Primary Examiner*—William Price

*Attorney, Agent, or Firm*—Skjerven, Morrill, MacPherson, Franklin & Friel

[57] ABSTRACT

A device for protecting a tarpaulin from damage, as it passes over the sharp corner of a load, which is mounted on a flat bed truck, or other transporting device. The protective device comprises three planar sides and a rounded corner, it is inserted between the load and the tarpaulin, at the corner of the load, and prevents direct bearing of the tarpaulin upon the sharp corner of the load.

12 Claims, 5 Drawing Sheets

FIG. 2
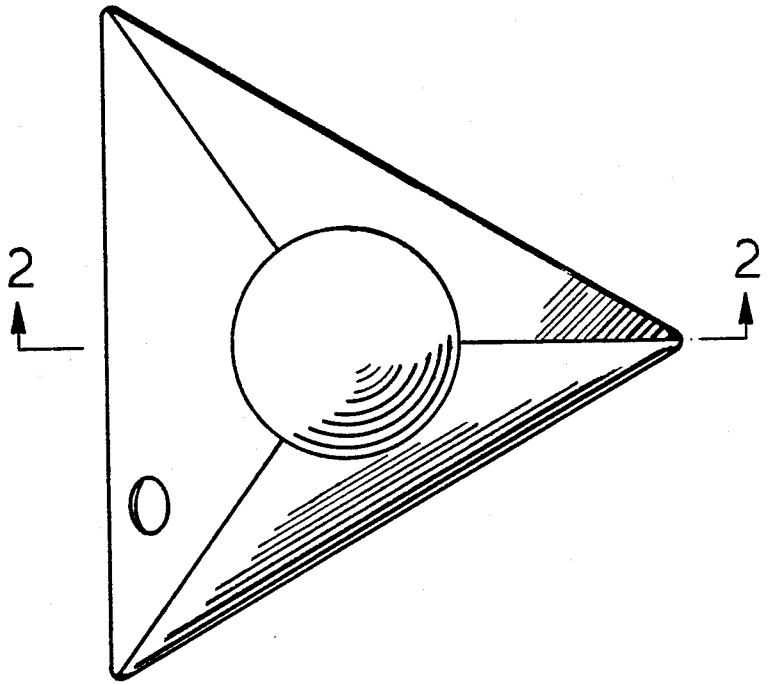
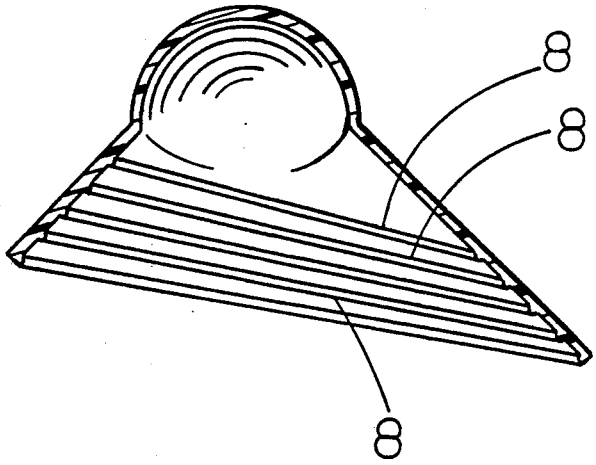
FIG. 3

TARPAULIN CORNER PROTECTOR

BACKGROUND OF THE INVENTION

The invention pertains to a corner protector, to protect a tarpaulin from damage by the sharp corner of a load while the load is being transported by truck, train, or other transportation means.

Truck operators frequently use tarpaulins to protect a load during transport. The tarpaulins are expensive, and it is desirable to get as long a life from them as possible. But they are subjected to buffeting by the wind and other strains which can result in rips and tears especially where they pass over a sharp corner of the load.

It is desirable to prevent this damage to the tarpaulin caused by the sharp corner of the load. Up until now there has been no means to do so. Heretofore there has been no device to protect a tarpaulin from such damage.

SUMMARY OF THE INVENTION

The purpose of the subject of the invention is to provide a means of protecting a tarpaulin, as it is used to cover a load on a truck, train, or ship, from the sharp corner of the load.

More precisely the device is an open right triangular pyramid with a blunted corner, which is inserted between the corner of the load and the tarpaulin as the tarpaulin is draped over the load.

BRIEF DESCRIPTION OF THE DRAWINGS

FIG. 2 is a top view of the tarpaulin protector as constructed of molded thermoplastic.

FIG. 3 is a section view through the tarpaulin protector as constructed of thermoplastic.

DETAILED DESCRIPTION OF PREFERRED EMBODIMENTS

Figure 1:
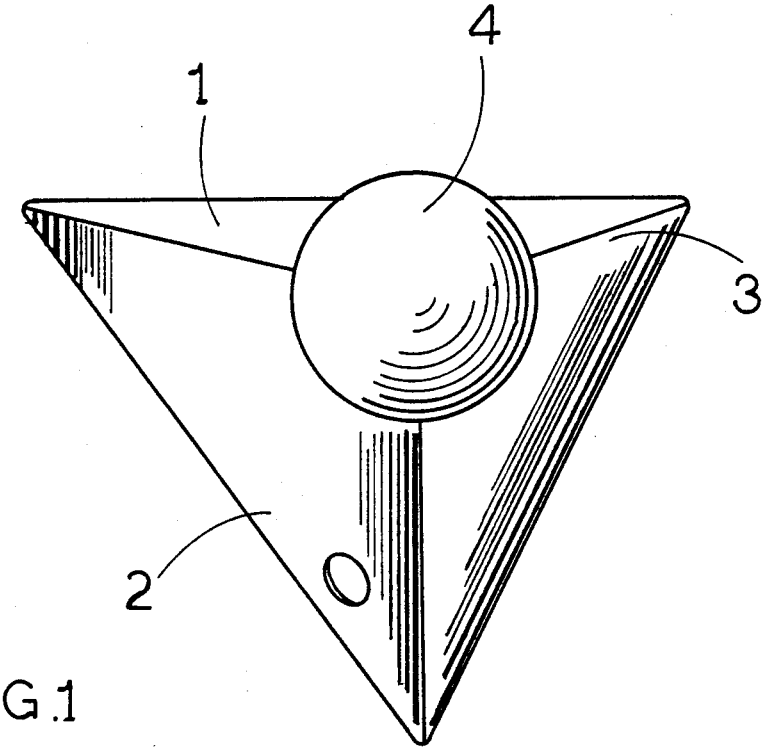
FIG. 1 is an isometric view of the tarpaulin protector as constructed of molded thermoplastic.

Referring to the drawings wherein like characters indicate like parts throughout the figures;

The tarpaulin protector in accordance with the invention is provided with three sides 1,2,3; which form a right triangular pyramid. The three sides are shaped so as to fit upon the three way corner of a load, 7; which is placed, for instance, on a flat bed truck.

Figure 4:
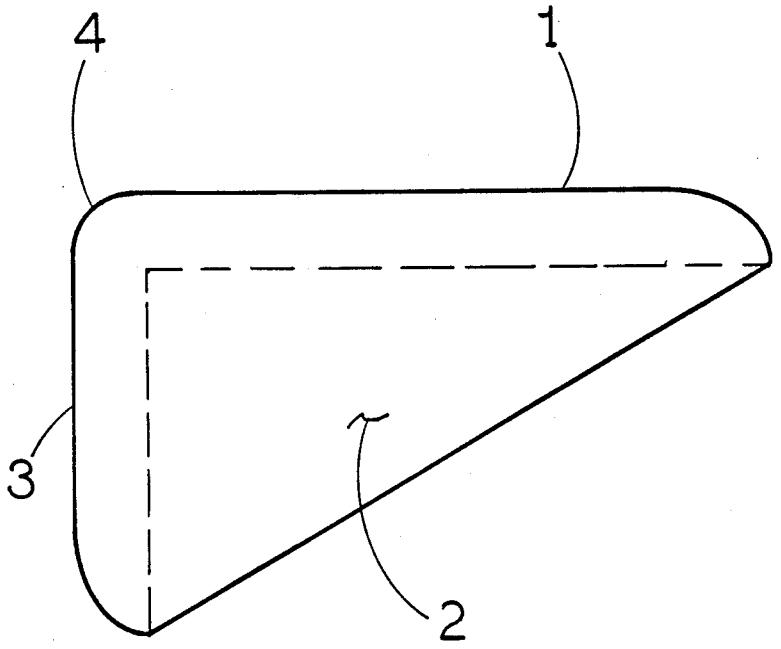
FIG. 4 is a side view of the tarpaulin protector as constructed of foamed plastic.

The intersection of the three sides of the tarpaulin protector, 1,2,3 is provided with means 4 of blunting the intersection of the 3 sides, which may be a spherical shape which intersects the three sides, in the case of molded thermoplastic construction, FIG. 1; and a general thickening and rounding of the corner, in the case of foamed plastic construction, FIG. 4.

Figure 5:
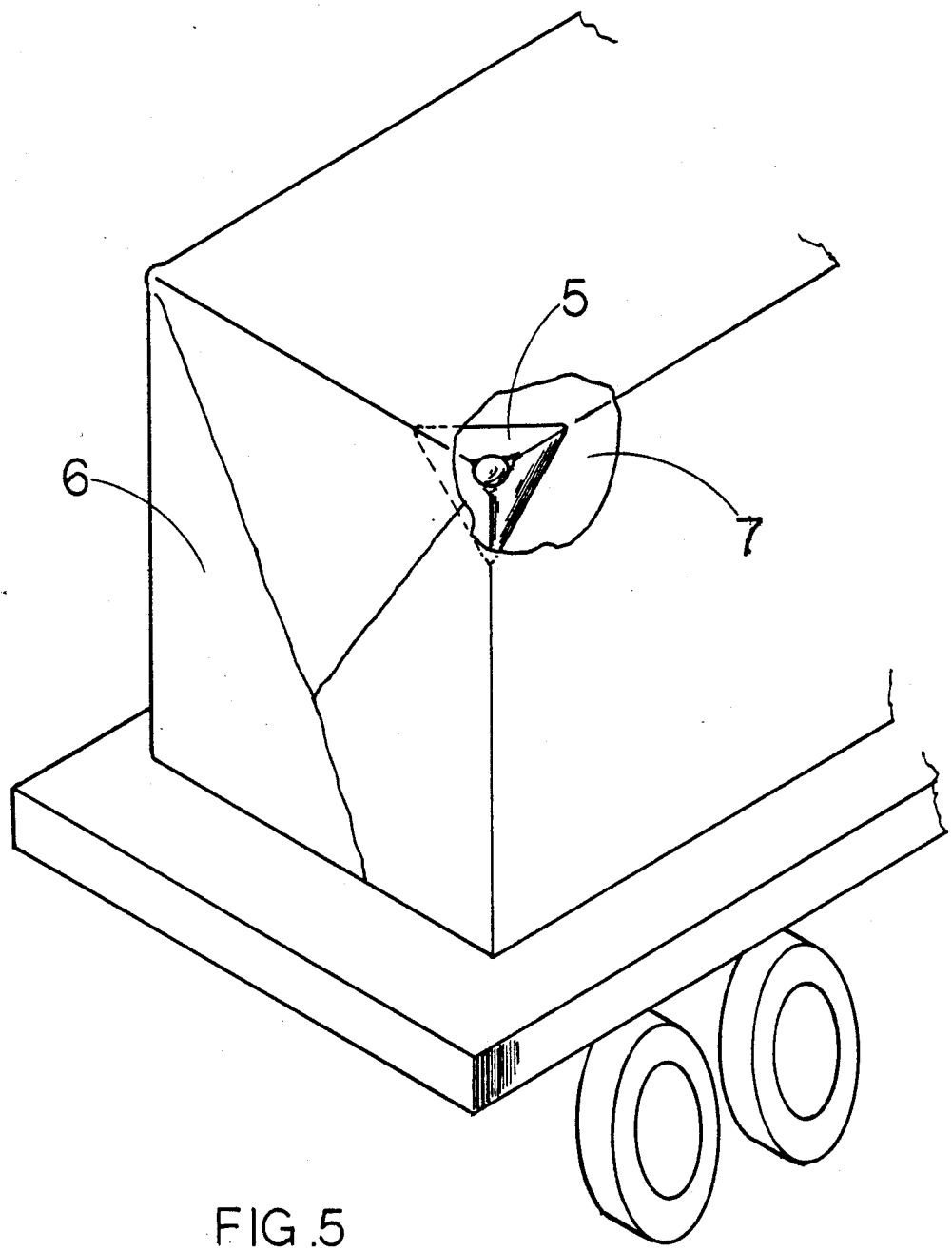
FIG. 5 is a view of the tarpaulin protector as it is installed on the load.
Figure 6:
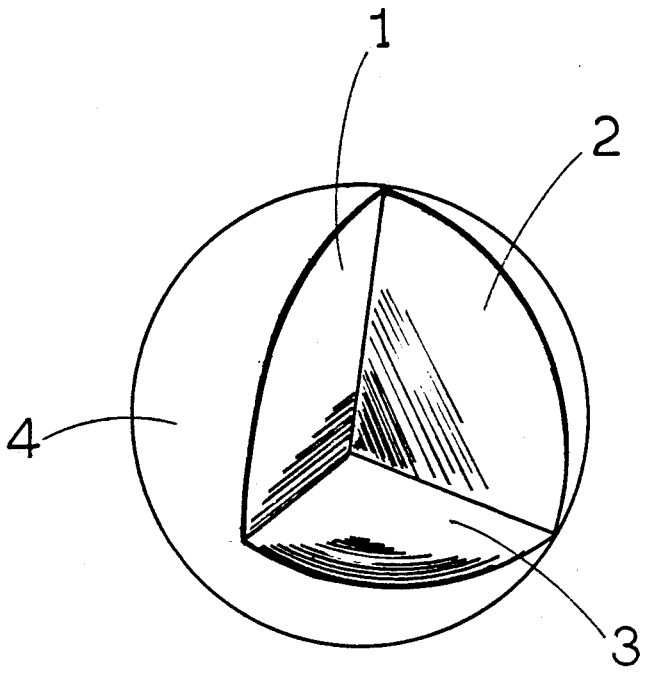
FIG. 6 is a view of the the tarpaulin protector in an alternate style of construction.

Referring to FIG. 5, the tarpaulin protector is used by inserting the tarpaulin protector 5 between the load 7 and the tarpaulin 6. In this way the tarpaulin protector blunts the sharp corner of the load 7 and redistributes the stress caused by the bearing of the tarpaulin 6 upon the corner of the load, 7. In one embodiment, the interior surfaces of sides 1, 2, 3 include raised ribs 8 (see FIG. 3) to enhance the ability of tarpaulin protector 5 to grip load 7.

While three preferred embodiments of the invention have been described, it is to be understood that such description is merely illustrative of the under lying features of the invention and is not intended to be limiting of the scope of the invention and the following claims.

What I claim is:

1. The combination comprising:

a first structure having at least one corner;

a second structure comprising three substantially planar sides, each side being substantially perpendicular to the other sides of said second structure, such that all three sides converge toward a vertex, a blunting means being formed at said vertex, said second structure being removably placed over said first structure so that said blunting means is located over said corner; and covering means draped over said first and second structures so that said blunting means causes stress in said covering means to be evenly distributed, thereby preventing tears in said covering means, said second structure being held in place by said covering means, such that if said covering means is removed, said second structure can be lifted off said first structure.

2. Combination as recited in claim 1, wherein said second structure is of molded thermoplastic.

3. Combination of claim 1 wherein said second structure is substantially shaped as a right triangular pyramid, and said first structure is a load placed on a transport means.

4. Combination as recited in claim 3, wherein said blunting means is a dome shape which intersects said pyramid.

5. Combination of claim 1 wherein said covering means is a tarpaulin and said blunting means is a dome formed at said vertex.

6. Combination as recited in claim 1, wherein the second structure is constructed of foamed plastic, and said blunting means is formed by a general thickening and rounding of the intersecting sides at the vertex.

7. Combination as recited in claim 1, wherein said second structure is an open shape and (a) said three sides form the inside surface of said open shape, and (b) said blunting means is formed by a general spherical shape forming the exterior surface of said open shape.

8. The combination of claim 1 wherein the inside surface of said second structure has raised ribs to enhance gripping of said second structure to said first structure.

9. A method for protecting a tarpaulin comprising the steps of:

providing a first structure having at least one corner;

removably placing over said corner a second structure having three substantially planar sides, each side being substantially perpendicular to the other sides such that all three sides converge to a vertex, said vertex being placed over said corner, said second structure including blunting means formed at said vertex; and draping covering means over said first and second structures, such that said blunting means prevents said covering means from being torn by said corner, and such that said covering means holds said second structure in place.

10. The method of claim 9 wherein said first structure is a load placed on a transport means and said second structure is shaped as a right triangular pyramid.

11. The method of claim 9 wherein said covering means is a tarpaulin and said blunting means is a dome formed at said vertex.

12. The method of claim 9 wherein said second structure is of molded thermoplastic.

* * * * *